US009581157B2

(12) United States Patent
Hayes-Pankhurst et al.

(10) Patent No.: US 9,581,157 B2
(45) Date of Patent: Feb. 28, 2017

(54) PUMP HAVING A HOUSING AND A ROTOR CAPABLE OF ROTATING IN THE HOUSING

(71) Applicant: QUANTEX PATENTS LIMITED, London (GB)

(72) Inventors: Richard Paul Hayes-Pankhurst, London (GB); Jonathan Edward Ford, London (GB)

(73) Assignee: QUANTEX PATENTS LIMITED, London (GB)

( * ) Notice: Subject to any disclaimer, the term of this patent is extended or adjusted under 35 U.S.C. 154(b) by 0 days.

(21) Appl. No.: 14/350,300

(22) PCT Filed: Oct. 4, 2012

(86) PCT No.: PCT/EP2012/069646
§ 371 (c)(1),
(2) Date: Apr. 7, 2014

(87) PCT Pub. No.: WO2013/050491
PCT Pub. Date: Apr. 11, 2013

(65) Prior Publication Data

US 2014/0348684 A1 Nov. 27, 2014

(30) Foreign Application Priority Data

Oct. 7, 2011 (GB) ..... 1117300.2

(51) Int. Cl.
*F03C 4/00* (2006.01)
*F04C 2/00* (2006.01)
(Continued)

(52) U.S. Cl.
CPC ..... *F04C 5/00* (2013.01); *F01C 5/04* (2013.01); *F01C 19/04* (2013.01); *F01C 19/10* (2013.01);
(Continued)

(58) Field of Classification Search
CPC ..... F01C 1/344; F01C 1/3442; F01C 19/04; F01C 19/10; F01C 21/0845; F04C 2/3443;
(Continued)

(56) References Cited

U.S. PATENT DOCUMENTS 763,525 A * 6/1904 Beresteyn ..... F04C 2/3443 418/127
3,690,791 A * 9/1972 Dieter ..... F02B 2053/005 123/242
(Continued)

FOREIGN PATENT DOCUMENTS

DE 199 16 252 11/2000
GB WO 2010122299 A2 * 10/2010 ..... F01C 19/04
JP 54 139103 10/1979

OTHER PUBLICATIONS

International Search Report for PCT/EP2012/069646 dated Dec. 13, 2012.
(Continued)

*Primary Examiner* — Theresa Trieu
(74) *Attorney, Agent, or Firm* — Nicholas B. Trenkle; Stites & Harbison, PLLC

(57) ABSTRACT

A pump includes a housings and a rotor capable of rotating within the housing. The rotor engages an interior surface of the housing in use, with at least two radially-inward shaped surfaces on the rotor forming respective chambers with the interior surface. In use, the chambers transport fluid from an inlet in the housing to an outlet in the housing as the rotor rotates. A seal provided between the inlet and the outlet will engage each of the shaped surfaces to prevent fluid passing from the outlet to the inlet as each shaped surface travels from the outlet to the inlet. The rotor includes a surface portion extending axially and circumferentially between respective edges of the shaped surfaces. On planes normal to
(Continued)

an axis of rotation of the rotor, the surface portion of the rotor has a greater curvature than that of the interior surface of the housing.

26 Claims, 9 Drawing Sheets

(51) Int. Cl.

| | |
|---|---|
| ***F04C 15/00*** | (2006.01) |
| ***F04C 5/00*** | (2006.01) |
| ***F04C 2/344*** | (2006.01) |
| ***F01C 19/10*** | (2006.01) |
| ***F01C 19/04*** | (2006.01) |
| ***F01C 5/04*** | (2006.01) |

(52) U.S. Cl.
CPC ..... *F04C 2/3443* (2013.01); *F04C 15/0015* (2013.01); *F04C 2240/20* (2013.01); *F04C 2240/802* (2013.01); *F04C 2250/20* (2013.01); *F04C 2250/301* (2013.01); *F05C 2225/00* (2013.01); *F05C 2225/02* (2013.01)

(58) Field of Classification Search
CPC .. F04C 5/00; F04C 2240/20; F04C 2240/802; F04C 2250/20; F05C 2203/06; F05C 2225/00; F05C 2225/02
USPC ..... 418/125, 127–129, 152–153, 156
See application file for complete search history.

(56) References Cited

U.S. PATENT DOCUMENTS

| | | | | |
|---|---|---|---|---|
| 3,771,901 | A | 11/1973 | Svensson | |
| 3,800,760 | A * | 4/1974 | Knee | F02B 2053/005 123/242 |
| 4,028,021 | A * | 6/1977 | Berkowitz | F01C 1/22 418/129 |
| 7,674,100 | B2 * | 3/2010 | Hayes-Pankhurst | F04C 5/00 418/156 |
| 2012/0034122 | A1 | 2/2012 | Hayes-Pankhurst et al. | |

OTHER PUBLICATIONS

Written Opinion of the International Searching Authority for PCT/EP2012/069646 dated Dec. 13, 2012.

* cited by examiner

PUMP HAVING A HOUSING AND A ROTOR CAPABLE OF ROTATING IN THE HOUSING

TECHNICAL FIELD

The invention relates to pumps.

BACKGROUND ART

It is known from PCT/GB 2005/003300 and PCT/GB 2010/000798 to form a pump with a housing and a rotor rotatably received in an interior surface of the housing. The housing has an inlet and an outlet and the rotor has a housing engaging surface that co-operates and seals with the interior surface of the housing. The rotor has at least one shaped surface radially inwardly of the housing-engaging surface and forming with the interior surface of the housing a chamber for conveying fluid from the inlet to the outlet on rotation of the rotor. A seal is provided between the outlet and the inlet to engage the shaped surface to prevent the passage of fluid from the outlet to the inlet.

In the pump of PCT/GB2005/003300 and PCT/2010/000798 the surfaces have a shape formed by the intersection with the rotor of an imaginary cylinder having an axis normal to the axis of the rotor. This produces a surface that is concavely curved in planes including the axis of the rotor. This defines the size of the chamber formed by the surface with the housing.

In the prior art, such a shape of surface has an abrupt change in profile where the edge of the surface meets the interior surface of the housing. This limits the maximum rotational speed as, owing to its inherent flexibility, the seal cannot follow the abrupt change of a profile, as is necessary to provide a continuous seal on fast rotations, and the seal is subject to more wear from abrasion caused by the sharp edge which is inherent in an abrupt change in profile.

SUMMARY OF THE INVENTION

According to the invention, there is provided a pump comprising a housing and a rotor rotatably received in the housing, the housing including a fluid inlet and a fluid outlet, the rotor including a housing-engaging surface co-operating with an interior surface of the housing to form a seal therebetween and also including at least first and second shaped surfaces radially inwardly of the housing engaging surface and each forming with the interior surface of the housing respective chambers for conveying fluid from the inlet to the outlet on rotation of the rotor, a seal being provided between the outlet and the inlet to engage the first and second shaped surfaces to prevent the passage of fluid from the outlet to the inlet as each shaped surface travels from the outlet to the inlet, the housing-engaging surface of the rotor including a portion extending axially and circumferentially between an edge of the first shaped surface and an edge of the second shaped surface and having in planes normal to the axis of the rotor a curvature greater than the curvature of the interior surface of the housing in corresponding planes.

In this way, the volume of each chamber formed between the surface and the housing can be increased so allowing greater throughput on each revolution of the rotor.

The following is a more detailed description of some embodiments of the invention, by way of example, reference being made to the accompanying drawings, in which:

DETAILED DESCRIPTION

Figure 1:
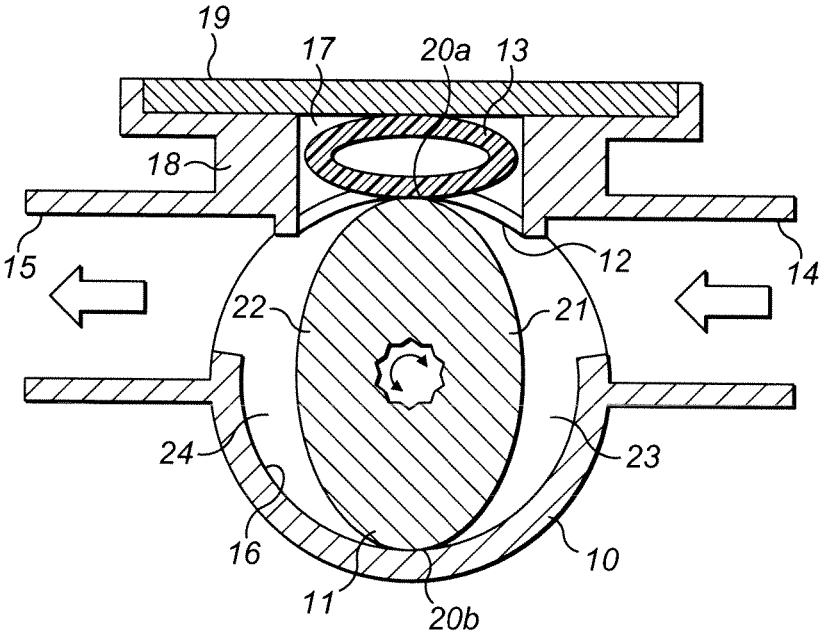
FIG. 1 is a schematic cross-section through a first form of pump showing a rotor mounted in a housing and including two shaped surfaces, a seal and a tube.

Referring first to FIG. 1, the pump is formed by a housing 10 containing a rotor 11 that engages a seal 12 supported by a resilient hollow elongate member in the form of a tube 13.

The housing 10 may be moulded from a plastics material and is provided with a fluid inlet 14 and a fluid outlet 15. As seen in FIG. 1, the inlet 14 and the outlet 15 are in axial alignment (although this is not essential). The interior of the housing 10 has an interior surface 16 that defines a longitudinally extending bearing surface for the rotor 11. The interior surface 16 is circular in cross-section and may lie on an imaginary cylindrical surface or frusto-conical surface in a longitudinal direction.

The interior surface 16 of the housing 10 is provided with an axially and circumferentially extending gap between the outlet 15 and the inlet 14 that is filled by the seal 12, which will be described in more detail below. The housing 10 includes a chamber 17 extending behind the seal 12 and formed by a surrounding wall 18 extending in a direction normal to the axis of the housing 10. One end of the wall 18 is closed by the seal 12 and the other end is closed by a cap 19. The cap 19 co-operates with the tube 13 in a manner to be described below.

The housing 10 is made from a suitable plastics material preferably by a one-shot moulding process. The seal 12 may be formed separately from the housing 10 and then fixed to the housing 10 or may be formed integrally in one-piece with the housing 10 from the same material as the housing 10 or from a more resilient material than the housing 10 by, for example, being co-moulded with the housing 10. The housing 10 may be formed of a resilient material that co-operates with the rotor 11 in a manner to be described below to form a seal between the parts.

The rotor 11 has an exterior housing-engaging surface 20 that is complimentary to the interior surface 16 of the housing 10. At the axially spaced first and second ends of the rotor 11, this surface 20 is of circular cross-section and engages the interior surface 16 of the housing 10 around the whole circumference of the housing 10 to form a seal between these parts. This seal may be enhanced if, as mentioned above, the housing 10 is resilient and is slightly distended by the housing-engaging surface of the rotor 11.

Intermediate the ends of the rotor 11, the rotor 11 is formed with first and second shaped surfaces 21, 22 that are radially inwardly of the housing-engaging surface 20 of the rotor 11. Thus, as seen in FIG. 1, each surface 21, 22 forms, with the housing 10, chambers 23, 24 for use in a pumping operation to be described below.

Figure 2:
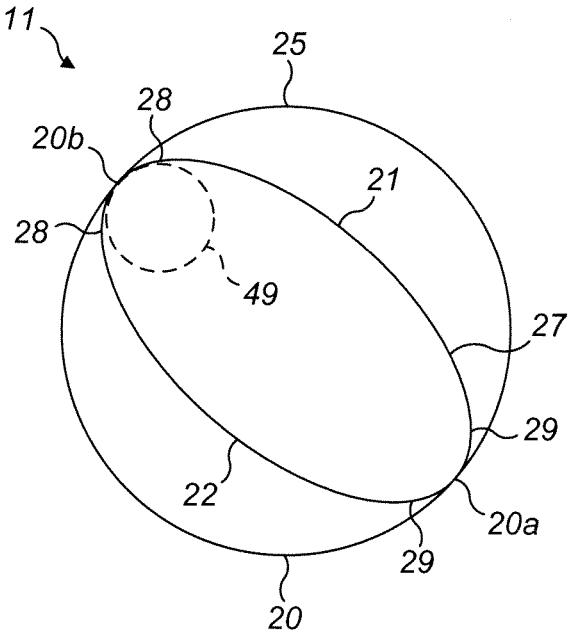
FIG. 2 is a schematic cross-section of the rotor of the pump of FIG. 1 showing various cross-sections along the rotor.

The first and second surfaces 21, 22 can have various shapes. Referring next to FIG. 2, it will be seen that the first axial end 25 of the rotor 11 is of circular cross-section in planes normal to the rotor axis as described above (and the second end (not shown in FIG. 2) is also of circular cross-section). In the centre of the rotor 11, in an axial direction, the cross-section of the rotor 11 in planes normal to the rotor axis may be an ellipse 27. In this case, the cross-section of the rotor 11 in planes normal to the rotor axis will change gradually from the circular cross-section at the first and second ends 25, 26 to the elliptical cross-section 27 at the centre. Thus the convex curvature of each surface 21, 22 in planes normal to the rotor axis is at its greatest at the first and second ends 25, 26 decreasing to its smallest intermediate the ends. Each surface 21, 22 is thus continuously curved in all directions with no sharp edges and where, at any point on each shaped surface 21,22 the angle between an imaginary line normal to the surface 21, 22 at that point and an imaginary line along a radius of the rotor 11 at that point is preferably not greater than 55°.

At any point on each surface 21, 22, the radius of curvature is preferably not less than 10% of the radius of the rotor 11. This is preferred in higher speed pumps.

The central cross-section of the rotor 11 need not be an ellipse as described above. Each surface 21, 22 may have the shape of an arc of a circle.

Alternatively, each surface 21, 22 may have axially and circumferentially extending flat portions at or around the centre.

Each surface 21, 22 is described by a first and second side edges 28, 29 that meet at the first and the second axial ends 25, 26 of the rotor. The housing-engaging surface 20 of the rotor 11 extends between these edges 28, 29 with first and second housing-engaging surface portions 20*a*, 20*b* and these portions 20*a*, 20*b* will contact and seal with the interior surface 16 of the housing 10 in this area to prevent leakage between the chambers 23, 24. These portions 20*a*, 20*b* of the housing-engaging surface 20 of the rotor 11 may, at any point, have the same curvature as the interior surface 16 of the housing 10 at that point. They may, however, have a curvature that is less than the associated curvature of the interior surface 16 of the housing at that point, lying on the surface of the imaginary circle 49 shown in broken line in FIG. 2, in order to reduce the contact area and thereby the friction. The curvature of the housing-engaging surface 20 of the rotor 11 may be 10% of the housing curvature. Intermediate the ends of the rotor 11, the circumferential extent of the contact between the housing-engaging surface 20 and the housing 10 may be as small as 1 mm or even a knife edge at each side of the rotor 11.

The rotor 11 is connected (or connectable) to a drive for rotating the rotor 11 in the housing 10 in a clockwise direction about the rotor axis as seen in FIG. 1. Since the rotor 11 described above with reference to the drawings is symmetrical about a plane including the rotor axis, it will pump with equal efficiency in either direction of rotation.

The seal 12 is in the form of a diaphragm formed by a thin sheet of a flexible material and its purpose is to seal against the rotor 11 as the rotor 11 rotates in the housing 10. As a result of the shape of the rotor 11, it is necessary for the diaphragm to be forced into contact with the rotor 11 and the tube 13 fulfils this purpose. The tube 13 may be formed from, for example, 60 Shore A silicone and is located in the housing chamber 17 between the cap 19 and the diaphragm 12. The tube 13 has its axis parallel to the axis of the rotor 11. The tube 13 may be compressed in all positions of the rotor 11 so that it applies a force to the diaphragm 12 at all times.

Figure 3:
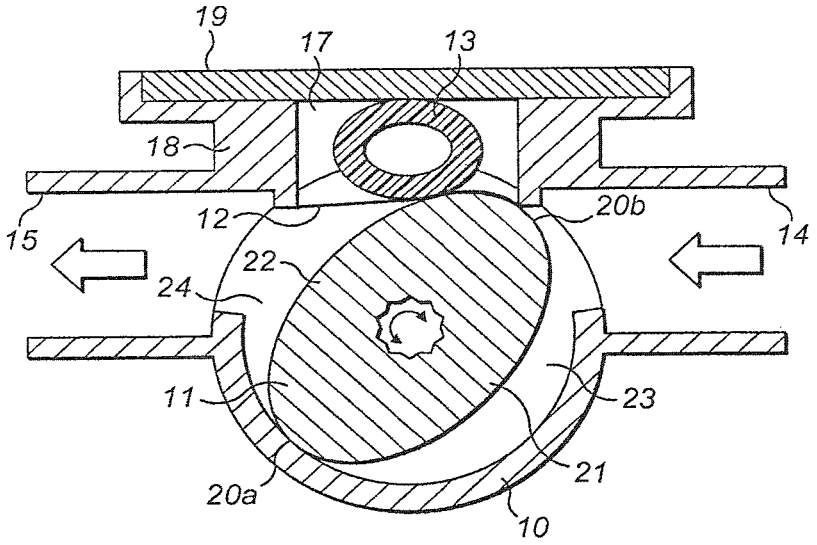
FIG. 3 is a similar view to FIG. 1 but showing the rotor rotated from its position in FIG. 1.
Figure 4:
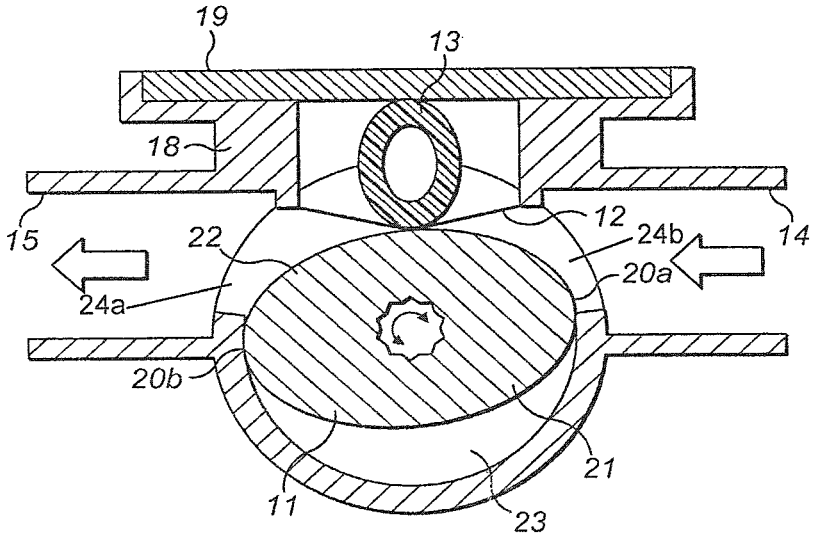
FIG. 4 is a similar view to FIG. 1 but showing the rotor rotated from its position in FIG. 3.
Figure 5:
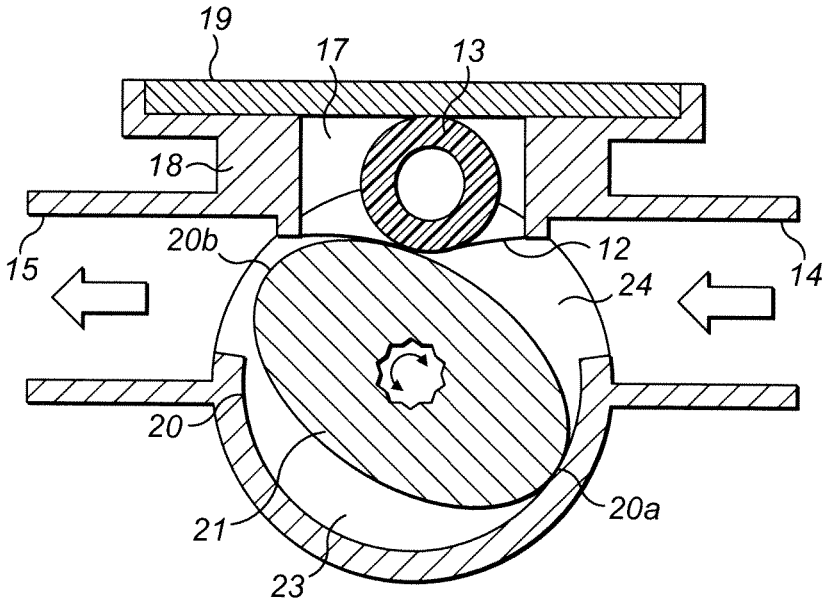
FIG. 5 is a similar view to FIG. 1 but showing the rotor rotated from its position in FIG. 4.

Referring additionally to FIGS. 3, 4 and 5, the pump operates as follows.

The inlet 14 is connected to a supply of fluid. The pump is capable of pumping a wide range of liquids and gasses including viscous liquids and suspensions such as paint (included in the definition of "fluids"). The outlet 15 is connected to a destination for the fluid. The rotor 11 is connected to a drive (not shown) which is preferably a controlled drive such as a computer controlled drive allowing controlled adjustment of the angular velocity and position of the rotor.

Starting from the top dead centre position shown in FIG. 1, fluid enters a chamber 23 at the inlet 14 formed by the first shaped surface 21 together with the housing 10 and exits a chamber 24 at the outlet 15 formed by the second shaped surface 22 and the housing 10. The diaphragm seal 12 engages the housing-engaging surface 20 of the rotor 11 to prevent fluid passing from the outlet 15 to the inlet 14 with the diaphragm seal 12 being urged against the rotor 11 by the tube 13.

On continued rotation of the rotor 11 (see FIG. 3) the second shaped chamber 24 is decreased in volume by the rotation of the second shaped surface 22 to force fluid from the second chamber 24 through the outlet 15 while rotation of the first shaped surface 21 increases the volume of the first chamber 23 to draw fluid in from the inlet 14. The diaphragm seal 12 remains in contact with the rotor 11 under the action of the tube 13, with the seal 12 contacting not only the housing engaging surface 20 of the rotor but also the second shaped surface 22.

Further rotation of the rotor 11 towards the bottom dead centre position (see FIG. 4) results in the first shaped surface forming a closed first chamber 23 with the housing 10 and containing a pre-determined volume of fluid. The second chamber 24 forms a part-second chamber 24*a* at the outlet 15 that continues to eject fluid through the outlet 15 and a part-second chamber 24*b* at the inlet 14 for the receipt of fluid. The diaphragm seal 12 engages the second shaped surface 22 to prevent the passage of fluid between the part-chambers.

The continued rotation of the rotor 11 (see FIG. 5) results in the first chamber 23 opening onto the outlet 15 so that substantially all of the fluid in the first chamber 23 exits the outlet 15. The second shaped surface 22 forms a second chamber 24 of increased volume at the inlet 14 so drawing further fluid into the chamber 24. The diaphragm seal 12 remains in contact with the rotor 11 under the action of the tube 13.

Continued rotation of the rotor 11 continues this action to pump fluid from the inlet 14 to the outlet 15.

The shapes of the first and second shaped surfaces 21, 22 with at least a portion that, in planes normal to the rotor axis, has a convex curvature, ensure that, as compared to previous proposals, the volume of the chambers 23, 24 and hence the volume of fluid pumped at each revolution is increased. At the same time, the seal between the rotor 11 and the housing remains sufficient to prevent the passage of fluid between them. In addition, the shapes of these surfaces 21, 22 reduce the area of engagement between the housing-contacting surface 20 and the housing 10 so decreasing the frictional resistance to rotation of the rotor 11 and so decreasing the required power and/or allowing higher rotational speeds. This can allow the use of cheaper and smaller motors. The increased pumped volume allows the pump to be smaller than previous proposals for the same maximum pumping rate. The use of a diaphragm seal 12 and tube 13 provides an improved wiping action between the seal 12 and the rotor 11 that may be important if the fluids contain particulates.

In addition, the curvature of the housing-engaging surface portions 20*a*, 20*b* ensures that there are no sharp changes in profile. This reduces wear on the seal 12 and allows higher rotational speeds.

Figure 6:
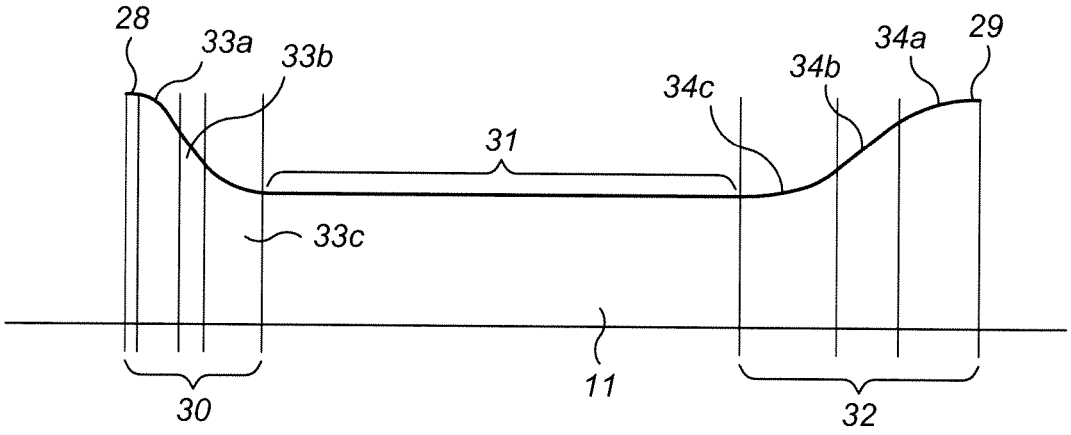
FIG. 6 is a schematic profile in a circumferential direction of a second form of a shaped surface of FIG. 1 with the profile shown transformed from a curve into a straight line.

Referring next to FIG. 6, the first and second shaped surfaces 21, 22 may be asymmetric in a circumferential direction in planes normal to the rotor axis. From the leading side edge 28 of the surface 21/22, the radial depth of the surface 21/22 below an imaginary circle centred on the axis of the rotor 11 and touching the radially outermost portion of the housing-engaging surface 20 may increase sharply in a first section 30, have a constant value in a central section 31 and then, in a second section 32 leading to the trailing side edge 29, decrease less sharply than in the first section 30. In addition, the first section 30 may be divided into first, second and third sub-sections 33*a*, 33*b* and 33*c* in which the first sub-section 33*a* is convexly curved with the minimum radius of curvature of the subsections, the second sub-section 33*b* has maximum slope and the third sub-section 33*c* is concave with the minimum radius of curvature. The second section 32 is divided into first, second and third sub-sections 34*a*, 34*b* and 34*c* that are similarly shaped to the first sub-sections 33*a*, 33*b* and 33*c* but of longer circumferential extent than the respective first sub-sections 33*a*, 33*b* and 33*c*. The sub-sections of each section join at common tangents so ensuring that there are no sharp changes of profile.

The effect of this is that, as a shaped surface 21/22 starts to pass across the diaphragm seal 12 from the leading edge 28, the rate of change of the depth of the shaped surface 21/22 is greater than the rate of change as the trailing edge 29 passes across the diaphragm seal 12. This is required because the diaphragm seal 12 can, under that action of the tube 13, follow the profile of the surface 21/22 more quickly when it is being pressed down onto the surface 21/22 than when it is being pushed back out.

It will be appreciated the diaphragm seal 12 seals against the shaped surfaces 21, 22 along the whole axial length of these surfaces 21, 22, Thus the seal 12 will be required to provide differing conformities along its axial length that will change with the angle of rotation of the rotor 11. As shown in FIGS. 1, 3, 4 and 5, the tube 13 has constant circular concentric interior and exterior cross-sections along its length and the cap 19 is of constant thickness. In order for the seal to adapt even better to these changing conformities, this need not be the case.

For example, the cap 19 may be flexible to contribute to the force applied through the tube 13 to the diaphragm seal 12. This flexibility may be varied along the axial length of the cap 19 by, for example, varying the thickness of the cap 19.

In order to achieve a required conformation of the seal 12 to the rotor 11, the tube 13 may be in the form of a hollow elongate member having interior and exterior circular cross-sections that are not concentric. One or both of these cross-sections may be non-circular—for example, elliptical or figure of eight or polygonal such as triangular or diamond-shaped. More than one tube 13 may be provided—for example, two stacked tubes may be provided.

Figure 7A:
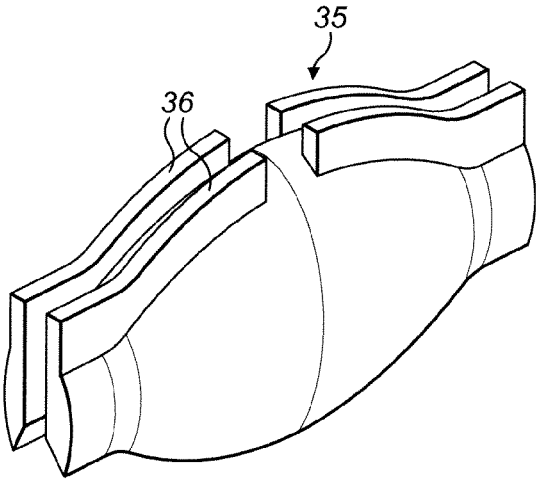
FIGS. 7*a* and 7*b* are a perspective view and an end elevation respectively of an alternative form of the tube of FIG. 1.
Figure 7B:
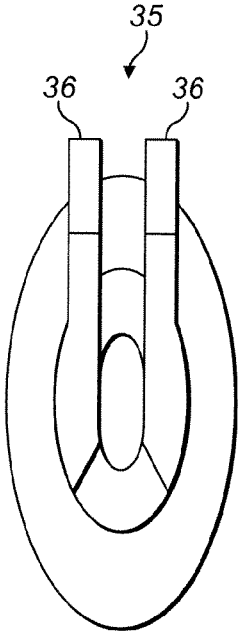

Referring next to FIGS. 7*a* and 7*b*, one further form of tube 35 has generally elliptical interior and exterior cross-sections and, as seen, has a greater major axis length at the centre of the tube 35 than at the ends. The purpose of this is to ensure as far as possible that the differences in contact pressure along the axial length of the rotor 11 are minimised during rotation of the rotor 11. At bottom dead centre ("BDC") when the seal 12 has to contact the maximum depth of a shaped surface 21,22, the tube 35 is designed to apply such a substantially constant pressure in an axial direction. At top dead centre ("TDC") when the seal has to contact a housing-engaging surface portion 20*a*, 20*b* of the rotor 11, the force will inevitably be higher because the tube 35 is more compressed but, for an ellipse, the force required to compress an ellipse per unit distance is not linear but follows an "S" shape so minimising the difference between BDC and TDC pressures. In addition, the tube 35 is provided with two parallel spaced ribs 36 extending along the exterior surface of the tube 35. These ribs 36 engage the cap 19 when the tube 35 is in the housing chamber 17 to locate the tube 35 in the chamber 17.

Figure 8:
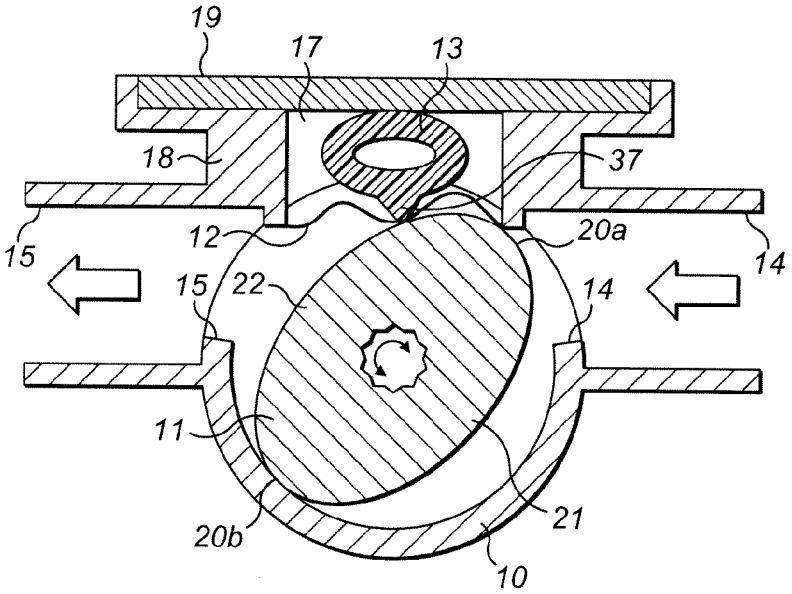
FIG. 8 is a similar view to FIG. 1 but showing a further form of the tube with a projection.

The area of engagement between the seal 12 and the rotor 11 may be reduced by forming the tube 13 with an axially extending projection. This is shown in FIG. 8 where parts common to FIG. 8 and to FIGS. 1, 3, 4 and 5 are given the same reference numerals and will not be described in detail. The tube has a V-section projection 37 extending axially along the tube 13 and engaging the diaphragm seal 12 so that only the area of the seal 12 engaged by the projection 37 is forced against the rotor 11. This reduces the frictional forces arising from such engagement while still providing an effective seal. The under surface of the diaphragm seal may be provided with a formation to locate this V-section projection 37. For example, this formation may comprise two spaced rows of projections on the under surface.

As described above, the diaphragm seal 12 is a thin sheet of material of uniform thickness across its area. This need not be the case. The diaphragm seal 12 may be shaped to provide variable flexibility characteristics across its area in particular to allow it to conform to the rotor 11 at the maximum depth of the rotor 11. For this purpose, it may, for example, be provided with circular ribs or corrugations on the surface of the diaphragm seal 12 that does not contact the rotor 11.

Figure 9:
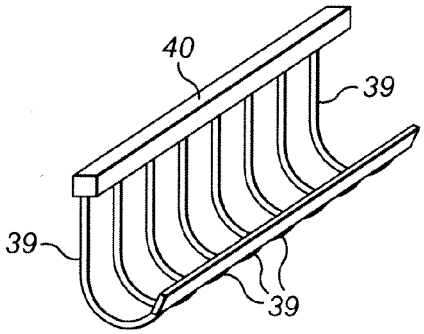
FIG. 9 is a perspective view of an array of polymer wipers for replacing the tube of FIG. 1.
Figure 10:
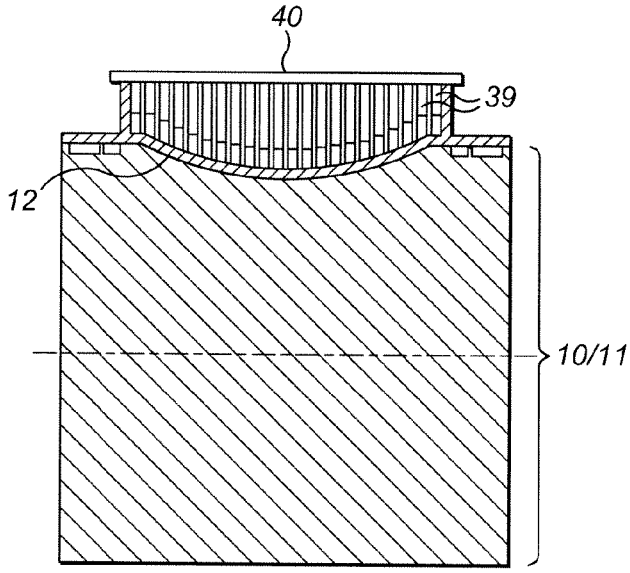
FIG. 10 is a schematic view of the action of the wiper of FIG. 9 on a diaphragm seal at a first rotor position, other parts being omitted for clarity.
Figure 11:
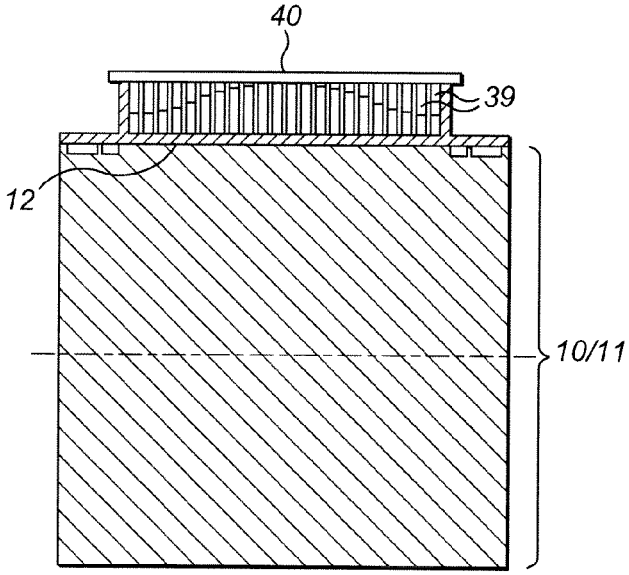
FIG. 11 is a schematic view of the action of the wiper of FIG. 9 on a diaphragm seal at a second rotor position, other parts being omitted for clarity.

Referring next to FIGS. 9, 10 and 11, the tube 13 of the embodiments described above with reference to the drawings may be replaced by other means for applying a force to the diaphragm seal 12. Referring to FIG. 9, one possibility is an array of wipers 39. Each wiper 39 is U-shaped and the wipers 39 are held in side-by-side register by a strip 40 that is connected to one set of free ends of the wipers 39. The wipers 39 are preferably made from a non-rubberised polymer such as an acetal, which has a lesser tendency to creep than materials such as polypropylene.

The array of wipers 39 is mounted in the housing chamber 17 with the apices of the wipers 39 in contact with the diaphragm seal 12 as seen schematically in FIGS. 10 and 11. Since each wiper 39 has one end free, each wiper can flex by a different amount to the other wipers so allowing the array to conform the seal 12 to the surface of the rotor 11. As seen in FIGS. 10 and 11, the wipers 39 may be of differing lengths axially along the seal 12 to provide an even force on the seal 12.

The wipers 39 are only required to bend and so are subject to low stress. They may accordingly be made of low cost recyclable materials so allowing the pump to be recycled.

Figure 12:
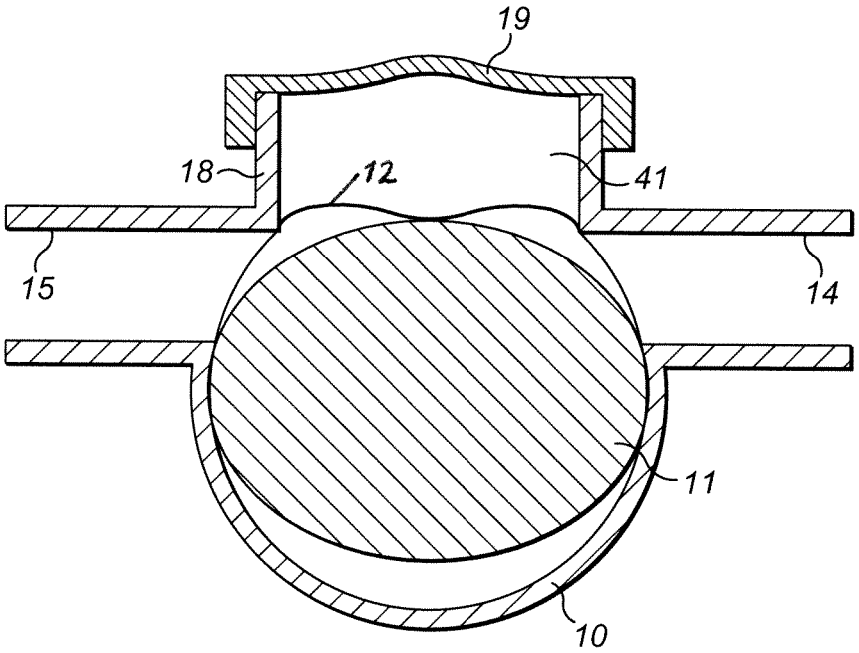
FIG. 12 is a schematic view of a pump of the kind shown in FIG. 1 with the tube replaced by a gel and showing the gel in a first disposition.
Figure 13:
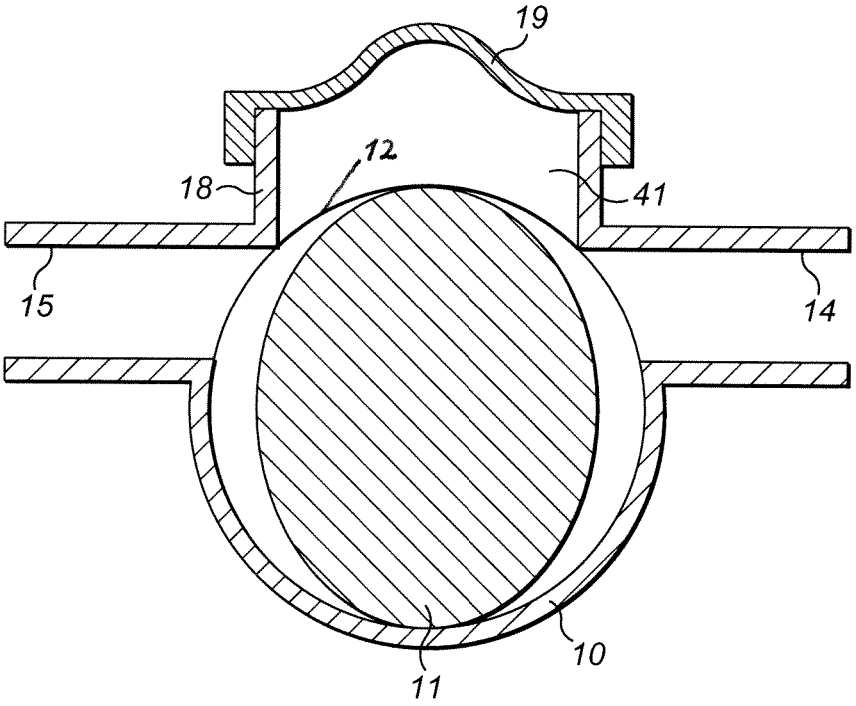
FIG. 13 is a similar view to FIG. 12 and showing the gel in a second disposition.

Another possibility is to replace the tube 13 with a fluid. Referring next to FIGS. 12 and 13, parts common to these Figures and to FIG. 1 are given the same reference numerals and are not described in detail. In this embodiment, the tube 13 is replaced by a fluid 41 that fills the housing chamber 17. The fluid 41 may be a liquid or gel that is held under pressure in the chamber 17. Where a gel is used, it may be water based using super absorbent polymers such a sodium polyacrylate or low density silicone or other material with similar properties. In this embodiment, the cap 19 is flexible and may be made of an elastomer.

In operation, the fluid 41 applies pressure to the diaphragm seal 12 to force it against the rotor 11 as the rotor rotates. Variations in the position of the seal 12 caused by the changing rotor profile are accommodated by variations in the flexing of the cap 19 so that, as seen in FIG. 13, maximum flexure of the cap 19 is achieved when the radially outermost part of the rotor 11 passes the seal 12.

Instead of being held under pressure, the fluid may be pressurised by a spring acting on the flexible cap 19.

Figure 14:
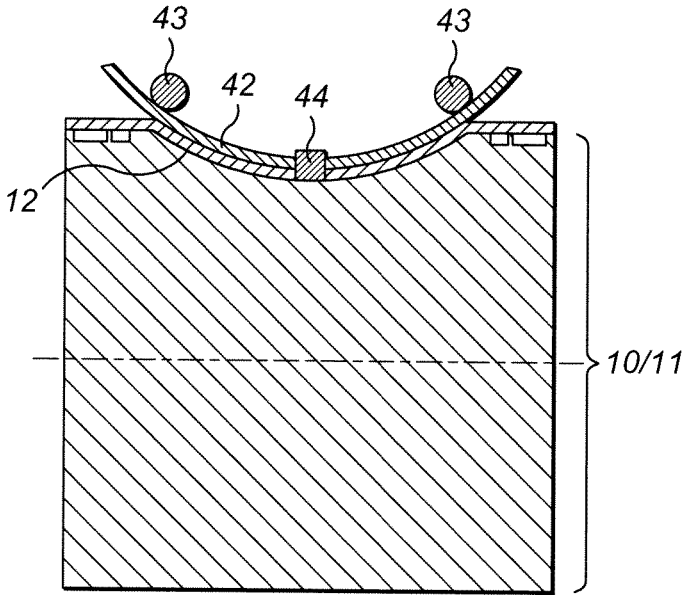
FIG. 14 is a schematic axial section of a pump of the kind shown in FIG. 1 with a spring replacing the tube and at a first rotor position, other parts being omitted for clarity, FIG. 15 a schematic view of the action of the spring of FIG. 14 at a second rotor position, other parts being omitted for clarity.
Figure 15:
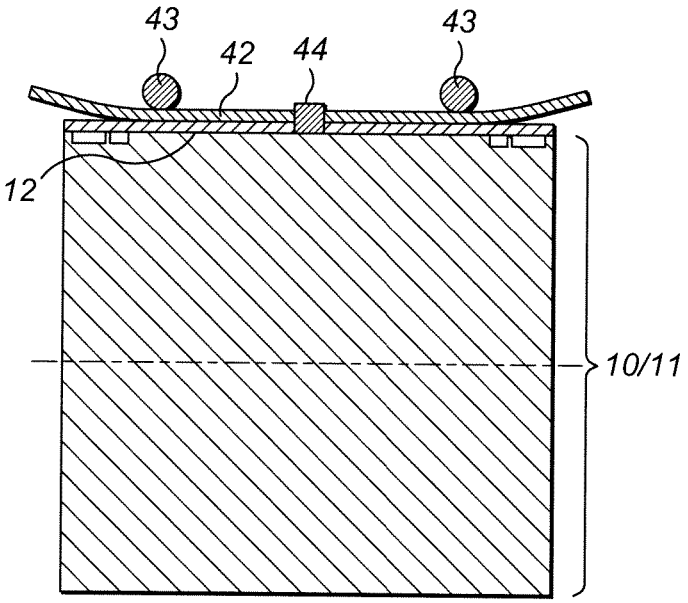

A further possibility is to replace the tube 13 with a spring. This embodiment is shown in FIGS. 14 and 15, in which parts common to these Figures and to FIG. 1 are given the same reference numerals and are not described in detail. In this embodiment, the axial profile of each shaped surface 21, 22 is, in planes normal including the rotor axis, made a smooth curve such as an arc of a circle or a catenary. So, for example, where the shape is an arc of a circle, successive axial profiles of the surfaces 21, 22 will be arcs of circles whose radius increases or decreases progressively.

A spring 42 is provided in the housing chamber 17. The spring 42 is in the form of a leaf or wire and made be of metal or polymer. The spring may be coated with a material that is softer than the material of the spring. The spring 42 may be formed to a profile so as to provide a required pressure on the seal 12 with the maximum pre-bent curvature being greater than the maximum axial curvature of the shaped surfaces 21, 22. The spring 42 is constrained to bend about a single axis normal to the axis of the rotor 11 by a pair of rollers or pivots 43 acting towards respective opposite ends of the spring 42 and by two ribs 44 moulded on the seal 12 and engaging respective opposite sides of the spring 42. As the rotor 11 rotates, the spring 42 conforms its shape to the axial profile of the portion of the rotor 11 contacting the diaphragm seal 12. The maximum flexure is shown in FIG. 14 and the minimum flexure in FIG. 15 when the spring 42 may be straight.

The seal that is formed between the rotor 11 and the housing 10 is sufficient to prevent the passage of many fluids between these parts. As is known, the housing 10 may be formed of a resilient material that is distended by the rotor 11 to improve the seal. It is also known to make the interior surface 16 of the housing 10 and the housing-engaging surface of the rotor 11 frusto-conical to allow relative axial adjustment between these parts to adjust the seal.

Figure 16:
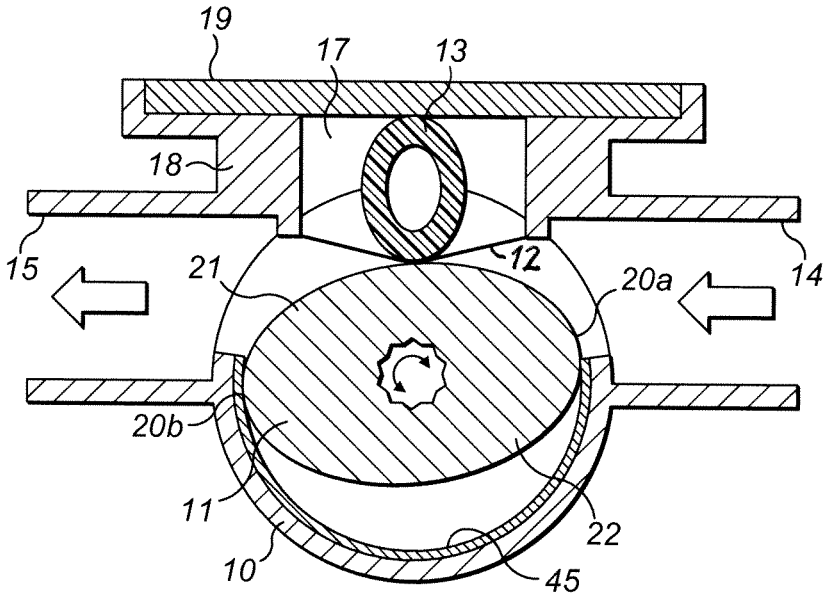
FIG. 16 is a similar view to FIG. 1 but showing a pump with a housing having a resilient lining.

Referring next to FIG. 16, the pump shown in this Figure has parts in common with the pump of FIG. 1. Those parts are given the same reference numerals and will not be described in detail. In the embodiment of FIG. 16, the interior surface 16 of the housing 10 is provided with a resilient liner 45 that extends over the entire contact area between the rotor 11 and the housing 10. The liner 45 may be of rubberised polymer or silicone rubber. This allows a larger tolerance between the housing 10 and the rotor 11 than could be accommodated by a housing 10 of resilient material. It is particularly useful where the housing 10 and the rotor 11 are cylindrical so that differences cannot be accommodated by relative axial movement of the parts, as would be the case if they were frusto-conical. It is also beneficial where the fluid being pumped contains abrasive particulates as wear between the rubbing surfaces is reduced.

In this case, the diaphragm 12 is preferably made of the same material as the liner 45. This allows greater deflection of the diaphragm 12 than would be the case if the diaphragm 12 were made of the less elastic material of the housing 10 and thus allows the shaped surfaces 21, 22 to have a greater maximum spacing from the housing 10 than would be the case if the diaphragm 12 were made of the less elastic material of the housing 10.

In the embodiments described above with reference to FIGS. 1 to 16, the inlet 14 and the outlet 15 are formed by tubes of circular cross-section. This can affect the maximum flow rate of the associated pump most particularly where the fluid being pumped is a high viscosity liquid (>100 cP).

The pressure drop of a Newtonian liquid flowing through a tube at a given velocity in laminar flow is directly proportional to the tube length and to the $4^{th}$ power of the diameter. So, for viscous liquids, the inlet and outlet to the pump need to be as large as possible. However there is a limit to the diameter that can be used. In FIG. 16 the top of the inlet/outlet diameter cannot be above the diaphragm seal 12 and the bottom of the inlet/outlet diameter cannot be below the centre-line of the housing axis (otherwise the inlet 14 and the outlet 15 can communicate when the rotor 11 is in the horizontal position). So the solution is to create the largest aperture in the housing 10 that meets the above constraints and then enlarge to an appropriately sized inlet/outlet tube with the shortest length of constrained aperture as possible (in FIG. 16 this is the housing wall thickness.)

In addition, the inlet and outlet ports 14, 15 may be axially elongate so that they span the full axial length of the shaped surfaces 21, 22.

Figure 17:
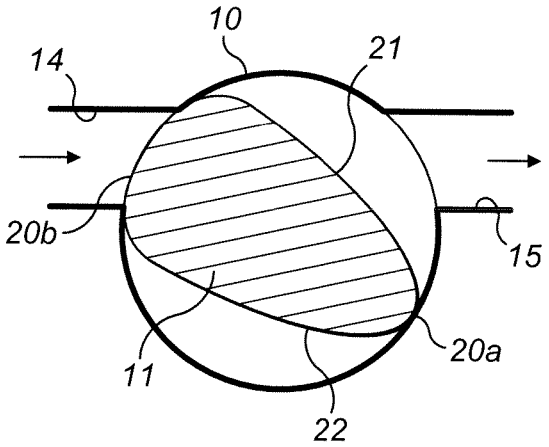
FIG. 17 is a schematic cross-section of a further form of pump with a housing having an inlet and an outlet and a rotor having different first and second housing-engaging rotor surface portions.

It will be appreciated that there are many modifications that may be made to the arrangements described above with reference to the drawings. In particular, there may be more than two shaped surfaces 21, 22. There may be three or more such surfaces equi-angularly spaced around the rotor 11. While the use of three or more shaped surfaces may (see below) decrease the volume of fluid conveyed by each rotation of the rotor 11, this arrangement will increase the accuracy with which a required volume of fluid can be measured and is particularly desirable for discreet doses where the volume of the chamber is a common denominator of the total dose required In the embodiments described above with reference to the drawings, the two portions of the housing-engaging surface 20 are the same shape. This need not be the case. Referring to FIG. 17, parts common to this Figure and to the previous figures are given the same reference numerals and will not be described in detail. In this embodiment, the second housing-engaging portion 20*a* is of lesser curvature and greater angular extent than the first housing engaging portion 20*b*. The second housing-engaging portion 20*a* may include a section having the same curvature as the interior surface of the housing 10 and the same or a greater angular extent than the inlet 14 so that, when the second housing-engaging surface 20*a* is in register with the inlet 14, it blocks the inlet 14. This is useful when the pump is incorporated in the outlet of a container (not seen in FIG. 17) of fluid since it allows the rotor 11 to block the inlet and so prevent the escape of fluid from the associated container.

Figure 18:
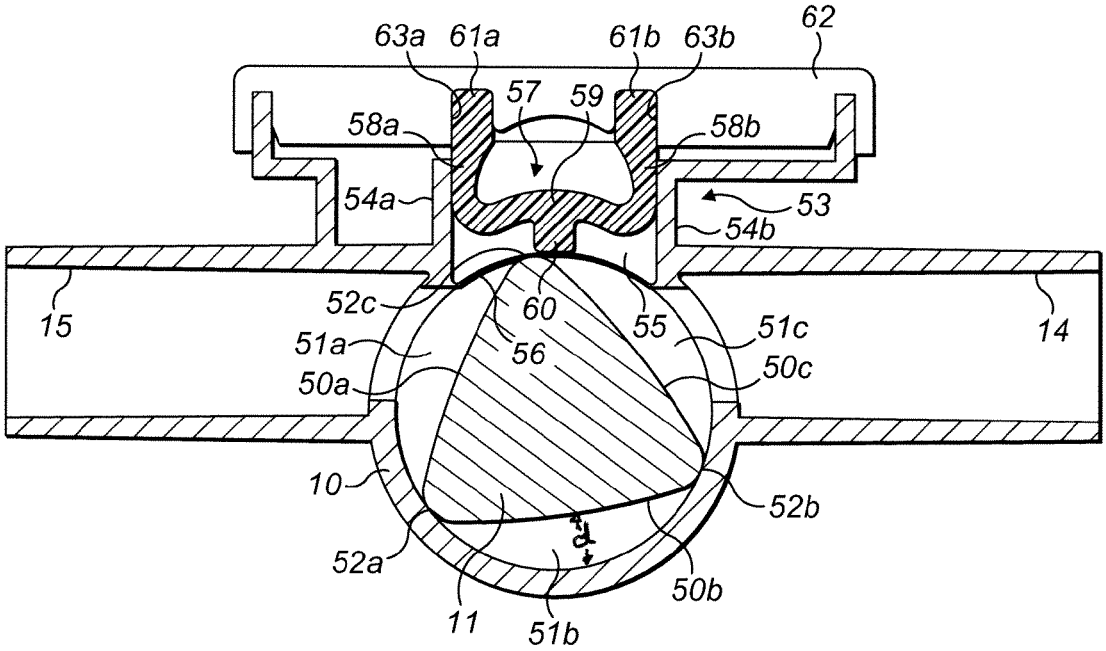
FIG. 18 is a schematic cross-section of another form of pump with a rotor having three housing-engaging surfaces.

Referring next to FIG. 18, in this embodiment, parts common to this Figure and to the earlier Figures are given the same reference numerals and will not be described in detail. In this embodiment, the housing 10 contains a rotor 11 that may be formed of precision ground metal or as a precision injection moulded plastics part formed from a resin such as acetyl. The rotor 11 is shaped as described in PCT/GB05/003300 or PCT/GB10/000798 but with three recessed surfaces 50*a*, 50*b* and 50*c*, shaped as described above with reference to the earlier Figures, that form chambers 51*a*, 51*b* and 51*c* with the housing 10. The rotor 11 has three housing-engaging surfaces 52*a*, 52*b* and 52*c*.

The housing 10 is formed between the inlet 14 and the outlet 15 with a seal retainer 53. The seal retainer 53 has parallel spaced side walls 54*a*, 54*b* leading from an opening 55 in the housing 10. Each side wall 54*a*, 54*b* extends parallel to the axis of the rotor 11 and has an axial length that is at least as long as the axial length of the surfaces 50*a*, 50*b* and 50*c*. End walls (not shown) interconnect the axial ends of the side walls 54*a*, 54*b*. A flexible diaphragm 56 forming the seal 12 closes the opening as described above and in PCT/GB05/003300 or PCT/GB10/000798.

The diaphragm 56 is supported by an elongate member 57 of inverted U-shape cross-section formed from an elastomeric material that is complaint flexible and resilient such as silicone rubber. The member 57 has spaced arms 58*a*, 58*b* interconnected by a base portion 59 carrying a rib 60 on its exterior surface. The rib 60 extends parallel to the longitudinal axis of the member. The free ends 61*a*, 61*b* of the spaced arms 58*a*, 58*b* are thickened. The member 57 is inverted in the retainer 53 with the outer side faces of the arms 58*a*, 58*b* pressing against the side walls 54*a*, 54*b* so that the ends of the base portion 59 are fixed relative to the side walls 54*a*, 54*b*. The rib 60 bears against the under surface of the diaphragm 56. The retainer 53 is closed by a cap 62 that includes parallel spaced channels 63*a*, 63*b* that receive respective free ends 61*a*, 61*b* of the arms 58*a*, 58*b* to locate the member 57 relative to the housing 10. The cap 62 compresses the member 57 so that the rib 60 is forced against the diaphragm 56.

The recessed surfaces 50*a*, 50*b* and 50*c* are shaped in an axial direction as described above with reference to the drawings.

In all the embodiments described above with reference to the drawings, the maximum spacing between each surface 21, 22 and 50, 50*b* and 50*c* and the interior surface 16 of the rotor 11, is determined by the flexibility of the diaphragm 12, 56. If the diaphragm 12, 56 exceeds its elastic limit, it will be permanently deformed and its ability to seal with the rotor 11 may be compromised. Accordingly, this spacing ("d" in FIG. 18) must be chosen in relation to the properties of the material of the diaphragm 12; 56 so that all stretching of the diaphragm 12; 56 takes place in the elastic range of the material of the diaphragm 12; 56.

This limitation on the maximum spacing "d" between each surface 21, 22; 50, 50*b* and 50*c* and the interior surface 16 of the housing 10 limits the volumes of the chambers 23, 24; 51*a*, 51*b* and 51*c*. Where the maximum spacing is reduced below a determinable minimum, the use of a three lobed rotor 11, as shown in FIG. 18, provides a greater volume of transported fluid per rotation than a two-lobed rotor 11 as shown in FIGS. 1 to 17. In the event that the maximum spacing "d" is required to be reduced still further as a result of the properties of the diaphragm 12, 56, a four lobed rotor 10 will provide a greater volume of transported fluid per rotation that a three lobed rotor.

Such a three lobed rotor 11 has other advantages. It can work at greater fluid pressures than a two lobed rotor 11 since there are two seals between the rotor 11 and the housing 10 as the rotor 11 rotates. In addition, although the total volume of the chambers 52*a*, 52*b* and 52*c* is greater in these circumstances than a two lobed rotor 11, the volume of each chamber 52*a*, 52*b* and 52*c* is less that the volume of the chambers 23, 24 of the embodiments of FIGS. 1 to 17, other dimensions being equal, and this provides greater resolution of the pumped fluid.

The pump described above with reference to FIG. 18 operates broadly as described above with reference to FIGS. 1 to 17 on rotation of the rotor 11. At bottom dead centre, when the flexing of the diaphragm into the housing 10 is a maximum, the base portion 59 is slightly flexed so that it applies to the rotor 11 via the diaphragm 56 just sufficient force to form a seal between the diaphragm 56 and the rotor 11 to prevent the passage of fluid from the outlet 15 to the inlet 14 with the elastic limit of the diaphragm not being exceeded, as described above. On continued rotation of the rotor 11 by about 45°, the rotor 11 forces the base portion 59 inwardly. This is accommodated by the base portion 59 reducing its curvature, as compared to the TDC position, which, in turn forces the arms 58*a*, 58*b* against the side walls 54*a*, 54*b* without compression of the arms 58*a*, 58*b*. Further rotation of the rotor 11, by 90° from the TDC to the position shown in FIG. 18 causes the rotor 15 to force the base portion 59 outwardly of the housing 11 to its maximum extent and this is accommodated by the base portion 59 of the member 57 inverting. This again does not result in any compression of the arms 58*a*, 58*b*. Indeed, in the act of inverting, the force applied by the member 57 to the rotor 11 may reduce. This flexing does not therefore change, or does not substantially change, the force applied by the rib 60 to the diaphragm 12 and thus the force applied by the diaphragm 12 to the rotor 1 since the change in profile from a pre-loaded circular form to an inverted form requires very little additional force.

The operation of the member 57 and similar members is described in more detail in our UK patent application No. 1202245.4.

The invention claimed is:

1. A pump, comprising:

a housing including a fluid inlet and a fluid outlet, the housing having an interior with an interior surface that extends longitudinally and is circular in cross-section;

a rotor capable of rotating in the housing about an axis when received in the housing, the rotor including a housing-engaging surface that cooperates with the interior surface of the housing to form a sealing interface therebetween, the rotor also including at least first and second shaped surfaces disposed radially inwardly of the housing engaging surface with each of the first and second shaped surfaces forming a respective chamber with the interior surface of the housing for conveying fluid from the fluid inlet to the fluid outlet on rotation of the rotor; and a seal provided between the fluid outlet and the fluid inlet to engage the first and second shaped surfaces to prevent fluid passing from the fluid outlet to the fluid inlet as each of the first and second shaped surfaces travels from the fluid outlet to the fluid inlet, and wherein the housing-engaging surface of the rotor includes a portion extending axially and circumferentially between an edge of the first shaped surface and an edge of the second shaped surface, and wherein a curvature of the portion of the housing-engaging surface is, in all planes normal to the axis of the rotor, greater than a curvature of the interior surface of the housing.

2. A pump according to claim 1, wherein the first and second shaped surfaces of the rotor are arranged symmetrically about a plane that includes the axis of the rotor.

3. A pump according to claim 2, wherein each of the first and second shaped surfaces has first and second circumferentially spaced edges, wherein a first housing-engaging surface portion extends between the first circumferentially spaced edge of the first shaped surface and the second circumferentially spaced edge of the second shaped surface, and wherein a second housing-engaging surface portion extends between the second circumferentially spaced edge of the second shaped surface and the first circumferentially spaced edge of the first shaped surface.

4. A pump according to claim 3, wherein the first housing-engaging rotor surface portion is of a same shape as the second housing-engaging rotor surface portion.

5. A pump according to claim 3, wherein the second housing-engaging surface portion includes a portion that, when the second housing engaging surface portion is in alignment with the inlet, blocks the inlet to prevent passage of fluid therethrough.

6. A pump according to claim 3, wherein, for each of the first and second shaped surfaces, the shaped surface has, between the first and second circumferentially spaced edges of the shaped surface, a depth radially inwardly of a radius of the housing-engaging surface that varies non-uniformly in a circumferential direction from the first circumferentially spaced edge to the second circumferentially spaced edge.

7. A pump according to claim 6, wherein each of the first and second shaped surfaces has a respective first circumferential section leading from the first circumferentially spaced edge of the shaped surface and a respective second circumferential section leading from the second circumferentially spaced edge of the shaped surface, and wherein, as each of the first and second shaped surfaces passes across the seal in use, a rate of change of the depth of the shaped surface between the first and second circumferentially spaced edges of the shaped surface is greater in the respective first circumferential section of the shaped surface than in the respective second circumferential section of the shaped surface.

8. A pump according to claim 7, wherein, for each of the first and second shaped surfaces, the respective first circumferential section of the shaped surface has a shorter circumferential extent than the respective second circumferential section of the shaped surface.

9. A pump according to claim 8, wherein, for each of the first and second shaped surfaces, the respective first and second circumferential sections of the shaped surface are each composed of respective first, second, and third sub-sections with each sub-section of each of the respective first and second circumferential sections having a different rate of increase of depth than the other sub-sections of the respective circumferential section.

10. A pump according to claim 6, wherein the rotor is arranged so that, for each of the first and second shaped surfaces, the first circumferentially spaced edge of the shaped surface is a leading edge in a direction of rotation of the rotor so that the first circumferentially spaced edge contacts the seal before the second circumferentially spaced edge of the shaped surface.

11. A pump according to claim 1, wherein a radius of curvature of the housing engaging surface or at least one of the housing-engaging surface portions is less than 10 percent of a radius of the interior surface of the housing at corresponding points.

12. A pump according to claim 1, wherein each of the first and second shaped surfaces is convexly curved in at least some planes normal to the axis of the rotor and concavely curved in planes including the axis of the rotor.

13. A pump according to claim 12, wherein each of the first and second shaped surfaces has first and second axially spaced ends with the convex curvature of the shaped surface in planes normal to the axis of the rotor being a maximum at the first and second ends and decreasing to a minimum intermediate the first and second ends.

14. A pump according to claim 13, wherein, for each of the first and second shaped surfaces, at and adjacent to the first and second ends, a convex curvature of the shaped surface is an arc of a circle and, intermediate the first and second ends, the convex curvature of the shaped surface is an arc of an ellipse.

15. A pump according to claim 13, wherein, for each of the first and second shaped surfaces, at and adjacent to the first and second ends, a convex curvature of the shaped surface is an arc of a circle and, intermediate the first and second ends, the shaped surface has a cross-section in a plane normal to the axis of the rotor that is a straight line.

16. A pump according to claim 12, wherein, for each of the first and second shaped surfaces, at each point on the shaped surface, an angle between an imaginary line normal to the shaped surface at said point and an imaginary line along a radius of the rotor at said point is greater than 55 degrees.

17. A pump according to claim 12, wherein, for each of the first and second shaped surfaces, at each point on the shaped surface, a curvature of the shaped surface has a radius that is not greater than 10 times a radius of the interior surface of the housing in a plane normal to the axis of the rotor through said point.

18. A pump according to claim 1, wherein at least part of the interior surface of the housing contacted by the rotor is formed by a liner of a material that is softer than a material of a remainder of the housing, and wherein the liner is resiliently deformed by the housing-engaging surface of the rotor as the rotor rotates within the housing to form the sealing interface between the liner and the housing-engaging surface of the rotor.

19. A pump according to claim 18, wherein the liner is a rubberised polymer or a silicone rubber.

20. A pump according to claim 18, wherein the seal is formed by a diaphragm.

21. A pump according to claim 20, wherein the liner is a rubberized polymer or a silicone rubber, and wherein the diaphragm is formed from a portion of the liner.

22. A pump according to claim 1, wherein the seal is formed from a flexible elastic material, and wherein a maximum spacing of each of the first and second shaped surfaces from the interior surface of the housing is such that, on rotation of the rotor, an elastic limit of the seal is not exceeded.

23. A pump according to claim 22, wherein the seal is formed integrally with the housing from a material of the housing.

24. A pump, comprising:

a housing including a fluid inlet and a fluid outlet;

a rotor capable of rotating in the housing about an axis when received in the housing, the rotor including a housing-engaging surface that cooperates with an interior surface of the housing to form a sealing interface therebetween, the rotor also including at least first and second shaped surfaces disposed radially inwardly of the housing engaging surface with each of the first and second shaped surfaces forming a respective chamber with the interior surface of the housing for conveying fluid from the fluid inlet to the fluid outlet on rotation of the rotor; and a seal provided between the fluid outlet and the fluid inlet to engage the first and second shaped surfaces to prevent fluid passing from the fluid outlet to the fluid inlet as each of the first and second shaped surfaces travels from the fluid outlet to the fluid inlet, and wherein each of the first and second shaped surfaces has first and second circumferentially spaced side edges and a convex curvature in all planes normal to the axis of the rotor, and wherein a depth of each of the first and second shaped surfaces, as measured radially inwardly from the housing-engaging surface, varies non-uniformly in a circumferential direction from the first circumferentially spaced side edge of the shaped surface to the second circumferentially spaced side edge of the shaped surface.

25. A pump, comprising:

a housing including a fluid inlet and a fluid outlet;

a rotor capable of rotating in the housing about an axis when received in the housing, the rotor including a housing-engaging surface that cooperates with an interior surface of the housing to form a sealing interface therebetween, the rotor also including at least first and second shaped surfaces disposed radially inwardly of the housing engaging surface with each of the first and second shaped surfaces forming a respective chamber with the interior surface of the housing for conveying fluid from the fluid inlet to the fluid outlet on rotation of the rotor; and a seal provided between the fluid outlet and the fluid inlet to engage the first and second shaped surfaces to prevent fluid passing from the fluid outlet to the fluid inlet as each of the first and second shaped surfaces travels from the fluid outlet to the fluid inlet, and wherein each of the first and second shaped surfaces is convexly curved in at least some planes normal to the axis of the rotor and concavely curved in planes that include the axis of the rotor.

26. A pump according to claim 25, wherein each of the first and second shaped surfaces is convexly curved in all planes normal to the axis of the rotor and concavely curved in all planes including the axis of the rotor.

* * * * *